United States Patent [19]

Wetmore et al.

[11] 4,070,570

[45] Jan. 24, 1978

[54] LIGHTING APPARATUS

[75] Inventors: Harold B. Wetmore, Needham; Robert A. Harrow, Sudbury; William C. Holway, Acton, all of Mass.

[73] Assignee: General Energy Development Corporation, Needham, Mass.

[21] Appl. No.: 700,786

[22] Filed: June 29, 1976

[51] Int. Cl.[2] ..... H05B 33/02

[52] U.S. Cl. ..... 362/218; 313/490

[58] Field of Search ..... 240/51.11, 11.2 E, 11.4 R; 313/174, 485, 488, 490, 493, 44, 45

[56] References Cited

U.S. PATENT DOCUMENTS

| | | | |
|---|---|---|---|
| 2,392,202 | 1/1946 | Tornblom | 240/51.11 R |
| 2,476,856 | 7/1949 | Geenens | 240/51.11 R |
| 2,760,053 | 8/1956 | Choisser | 240/11.4 R |
| 2,874,270 | 2/1959 | Douglass et al. | 240/11.4 R |
| 3,140,054 | 7/1964 | Oharenko | 240/11.4 R |
| 3,249,749 | 5/1966 | Haas | 240/11.4 R |
| 3,263,111 | 7/1966 | Doering | 313/490 |
| 3,786,247 | 1/1974 | Eilert et al. | 240/11.4 R |
| 3,809,944 | 5/1974 | Jongerius et al. | 313/488 |
| 3,833,801 | 9/1974 | Trevithick | 240/11.4 R |
| 3,906,284 | 9/1975 | Franck et al. | 313/490 |

*Primary Examiner*—L. T. Hix
*Assistant Examiner*—Alan Mathews
*Attorney, Agent, or Firm*—Wolf, Greenfield & Sacks

[57] ABSTRACT

A rugged lighting device that is preferably for use in explosive atmosphere such as on heavy coal mining equipment has a fluorescent lighting source that is readily replaceable without requiring disassembly of the device. The lighting apparatus is constructed to operate at a very efficient high output light level even over extended periods of operation and employs either a heat sinking technique for providing this efficient operation or preferably a very high output fluorescent tube designed for high temperature operation and having an amalgam patch. The apparatus basically comprises front and rear support structures interconnected by a transparent lamp tube, a lamp assembly slideably received by the lamp tube, and a cage mounted over the support structures for protecting the lamp assembly. The front support structure is constructed to receiving electrical wiring for the lamp assembly and comprises female connector means for mating with a male connector means of the lamp assembly. The rear support structure comprises a cap which may be removed to permit withdrawal of the lamp assembly. The lamp assembly comprises, in addition to a fluorescent lamp, mounting means for opposite ends of the lamp, a ground plane and, in one embodiment, heat sink means disposed at the rear end of the lamp assembly.

23 Claims, 8 Drawing Figures

LIGHTING APPARATUS

BACKGROUND OF THE INVENTION

The present invention relates in general to a lighting apparatus and is concerned, more particularly, with a fluorescent-type lighting device. Although the apparatus disclosed herein is for use with coal mining equipment, it is understood that the principles of this invention may be applied in different fields of use.

The lighting devices that are presently employed on coal mining equipment are not satisfactory for a number of reasons. Many of these devices are not operated efficiently and there is an excess amount of electricity that is used in order to maintain even a minimum predetermined light level in the mines. Some of the prior art devices are rather crude in construction and do not provide sufficient protection for the light source. Other known devices are not easily disassembled while others require that almost the entire device be disassembled to replace the light source. One of the problems that has been encountered is that, since these units are completely sealed to prevent explosions in hazardous atmospheres, there is no convection cooling that can be used and thus the lamp, when warmed up, operates at a significantly reduced light level. Other prior devices require a relatively large area on the machine for attachment, whereas our unit uses less space and fewer of the units are needed to provide the same total light output.

Accordingly, one object of the present invention is to provide a lighting appratus of improved construction and one which overcomes the hereinbefore recited deficiencies of prior art devices.

Another object of the present invention is to provide a lighting apparatus which is more efficient in operation and can operate at higher light output levels than comparable devices. In accordance with the invention two techniques can be used. One is a heat sinking technique and the other depends on a specially designed fluorescent amalgam lamp using a mercury pressure regulating technique.

A further object of the present invention is to provide a lighting apparatus which comprises a lamp assembly which is easily removed from the lighting apparatus for the purpose of replacing the light source.

Still another object of the present invention is to provide a lighting apparatus which also includes a protective cage mounted about the light assembly for protection thereof.

A further object of the present invention is to provide a lighting apparatus that is rugged in construction, easy to maintain and is inherently safer in operation in hazardous atmospheres. In accordance with this invention the fluorescent tube is spring biased at both ends so that if the tube breaks the opposite ends of the tube will be automatically disengaged from their electrical contact points.

A further object of the invention is to provide a luminaire having a high optical efficiency partly with the use of a reflector which is built in as part of the lamp. This reflector is preferably a 135° reflector.

SUMMARY OF THE INVENTION

To accomplish the foregoing and other objects of this invention the lighting apparatus comprises a pair of spaced support structures each of which may comprise a mounting pad and associated housing, a transparent tube means extending between the support structures and fixedly received thereby, and a lamp assembly slidably received by the tube means. The mounting pads may be bolted directly to a weld pad on the mining equipment. Each of the housings define a through chamber sealed at opposite ends by a threaded cap. The transparent tube means extends between these housings and is fitted into the respective chamber passages of the housings. The front has a connector means disposed in its chamber in a fixed position. The lamp assembly likewise has a connector means that mates with the connector means in the housing to provide electrical connection to the lamp assembly. The lamp assembly comprises a tubular fluorescent lamp which in one embodiment is a conventional fluorescent tube, a pair of spaced holding means, both of which are preferably spring-loaded, a ground plane extending between the holding means and means for pulling the lamp assembly so that the connector can disengage and the lamp assembly can be withdrawn from the apparatus through the other housing chamber after the sealing cap has been removed therefrom. In one embodiment the lamp assembly comprises a heat sink or heat shield which extends over one end of the fluorescent lamp and maintains a "cold spot" in the lamp for enhancing the output light level obtainable from the light source. In the preferred embodiment mechanical heat sinking is not used but there is instead provided an amalgam lamp of novel construction. A protective cage is also provided for protecting the lamp assembly and the transparent tube means. This protective cage is mounted from the spaced mounting pads.

BRIEF DESCRIPTION OF THE DRAWINGS

Numerous other objects, fetures and advantages of the invention should now become apparent upon a reading of the following detailed description taken in conjunction with the accompanying drawings, in which.

DETAILED DESCRIPTION

Figure 1:
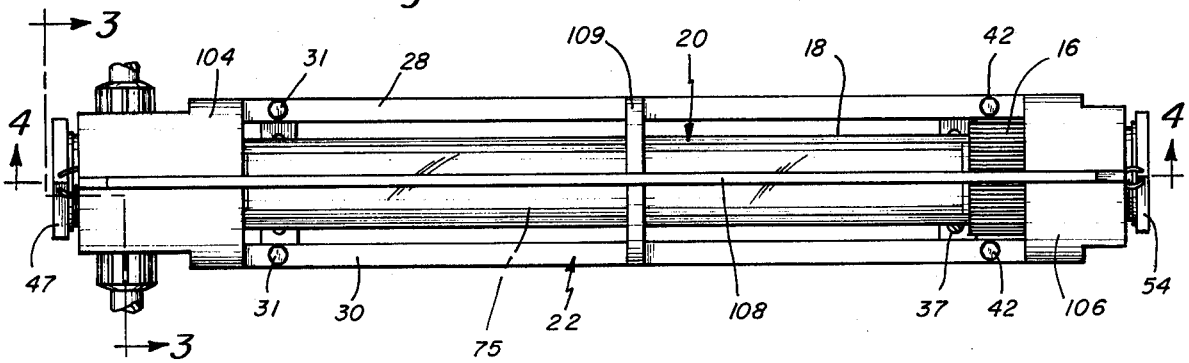
FIG. 1 is a top view of a device constructed in accordance with the principles of this invention.
Figure 2:
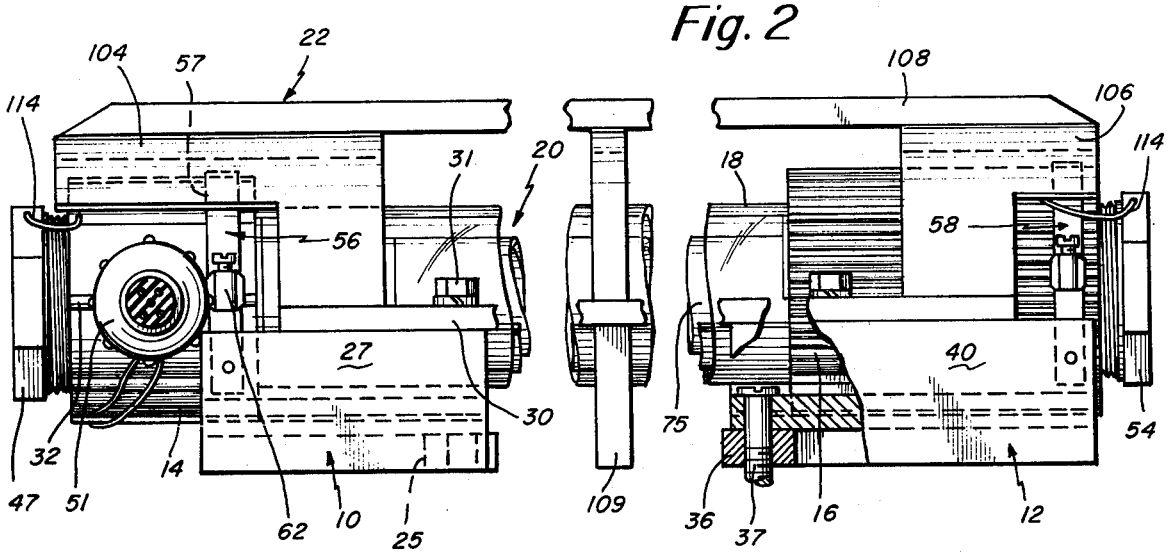
FIG. 2 is a somewhat enlarged partially cut away side elevation of the device shown in FIG. 1.
Figure 3:
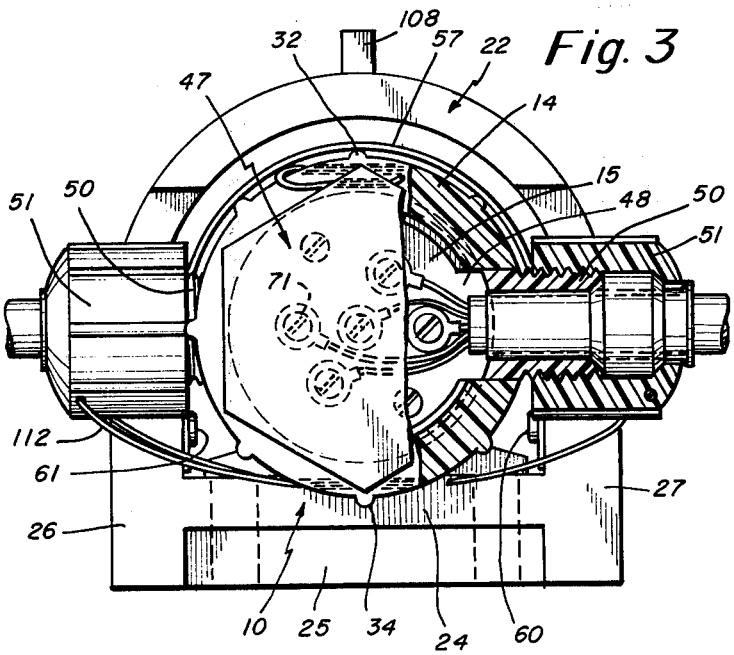
FIG. 3 is a cross sectional view taken along line 3—3 of FIG. 1.
Figures 4, 5, 6:
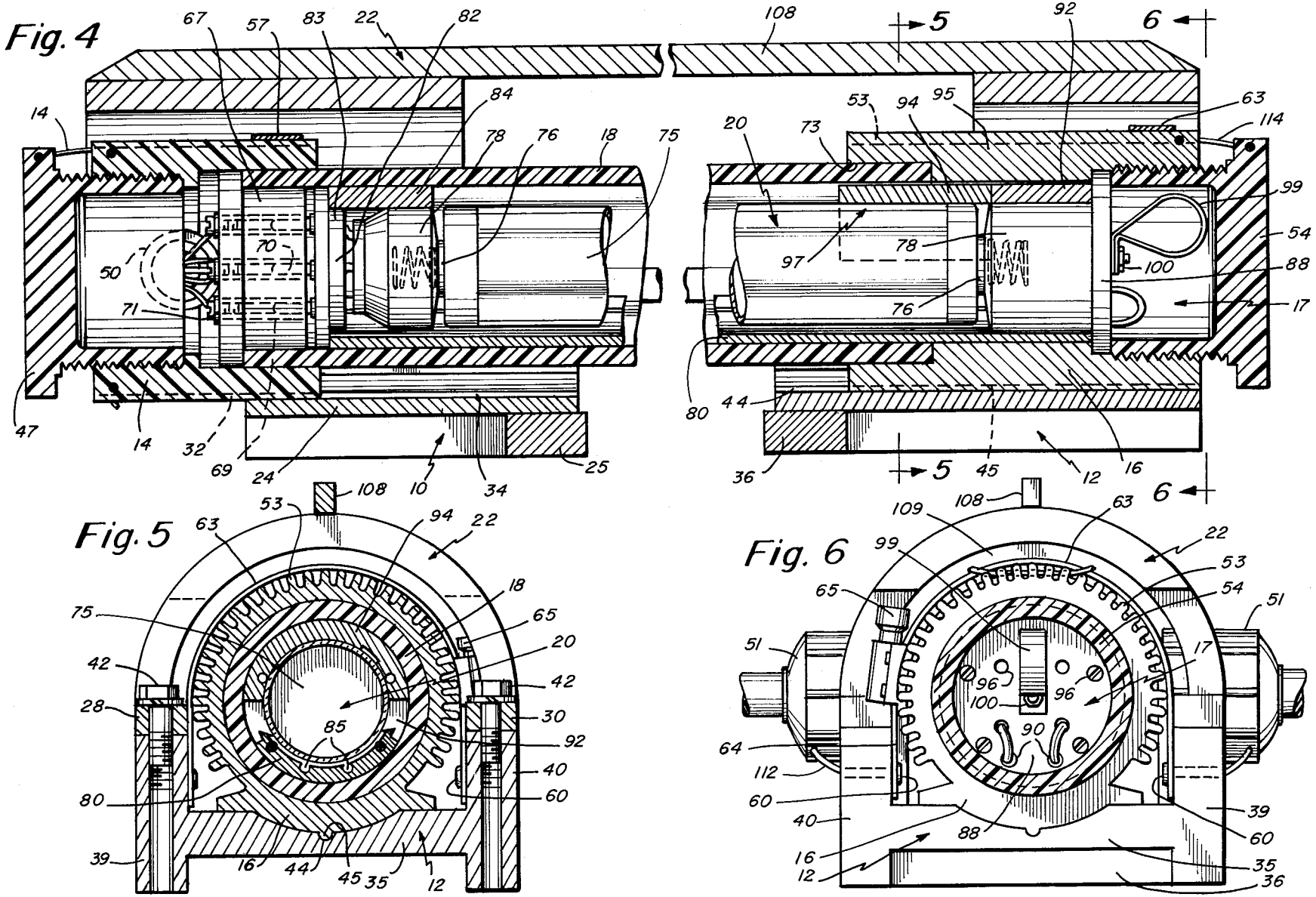
FIG. 4 is a cross-sectional view taken along line 4—4 of FIG. 1.
FIG. 5 is a cross-sectional view taken along 5—5 of FIG. 4.
FIG. 6 is a cross-sectional end view taken along line 6—6 of FIG. 4.

Referring now to the drawings and in particular to FIGS. 1 and 2, the apparatus generally comprises a front mounting pad 10, rear mounting pad 12, front chamber housing 14, rear chamber housing 16, elongated tube 18, lamp assembly 20, and protective cage 22. The mounting pad 10 is shown in FIGS. 2–4 and comprises a base 24 which is secured to a weld pad 25. The mounting pad 10 may be secured to the weld pad by means of a bolt arrangement such as shown in FIG. 2. FIG. 3 also shows in dotted passages for receiving the bolt for securing the base 24 to the weld pad 25. The weld pad may in turn be secured to a piece of equipment on which the apparatus of this invention is to be mounted. The mounting pad is a unitary piece and also comprises upright walls 26 and 27. The bottom of these upright walls forms a channel for receiving the weld pad. The bars 28 and 30 of the cage 22 are secured to the respective walls 26 and 27 by the bolts 31 shown in FIG. 1. The bolting arrangement may be like that shown for the other mounting pad 12 shown in FIG. 5 and discussed hereinafter.

FIG. 3 shows the chamber housing 14 which is of generally cylindrical shape and has a plurality of elongated ribs 32 extending longitudinally therealong. The base 24 has a mating channel 34 for receiving one of the ribs 32 to position the chamber housing 14 in the proper position relative to the mounting pad 10.

The rear mounting pad 12, as indicated in FIG. 5, has a similar configuration to the front mounting pad 10. The pad 12 comprises a base 35 which is secured to a weld pad 36 shown in FIG. 2. The base 35 and weld pad may be secured together by a bolt such as the bolt 37 shown in FIG. 2. Actually, a pair of bolts are preferably used arranged as shown in dotted in FIG. 3. The pad 12 also comprises upright walls 39 and 40 each having lower legs and upper ends upon which the bars 38 and 39, respectively rest. FIGS. 1 and 5 show the bolts 42 for securing the bars 28 and 30 to the mounting pad.

The base 35 of pad 12 also has a channel 44 like the channel 34 shown in FIG. 3 for accommodating a ridge 45 of the rear chamber housing 16.

The front chamber housing 14 is shown most clearly in FIGS. 2–4 and is threaded at its outer end to receive a threaded cap 47. Both the housing 14 and the cap 47 may be constructed of an insulating material such as polyvinylchloride or a non-insulating cast or machined metal such as aluminum or brass. As indicated in FIG. 3, the chamber housing 14 defines an inner chamber 15 which is sealed by the cap 47. Also, there are diametrically opposed holes 48 in the housing 14 receiving respective nipples 50. The nipples may be glued into the holes 48. A nut 51 threadedly mates with each of the nipples 50. A bushing or packing is provided in the passage defined between the nipple 50 and the nut 51. Alternatively, as in the case of a cast or machined metal housing, the threaded nipples are replaced by internally threaded holes which secure the bushing packing material and externally threaded packing gland nut or plug. As indicated in FIG. 3 electrical wiring passes through these elements to the chamber 15. In another embodiment possibly only one wiring opening is provided to the chamber 15 rather than the two shown in FIG. 3.

The chamber housing 16 is of a somewhat different configuration than the housing 14. The housing 16 is preferably constructed of a metallic material such as an extruded aluminum. The housing 16 rests upon the base 35 of the rear pad as shown in FIGS. 4 and 5 and is interlocked by means of the ridge 45 in the housing. The housing also has a plurality of spaced fingers 53 disposed about the housing 14. These fingers assist in heat dissipation from the lamp as they create a larger outer surface area on the housing.

The outer end of the housing 16 is threaded as shown in FIG. 4 for receiving a threaded cap 54 for sealing the end of the chamber 17. The cap 54 may be of identical shape and size to the cap 47 used at the other end of the apparatus.

Means are provided for securing both of the housings 14 and 16 on their respective mounting pads 10 and 12. FIG. 2 shows a clamp 56 for securing the housing 14 and a clamp 58 for securing the housing 16. Each of the clamps are of the same type. FIG. 3 shows the clamp 56 which comprises an elongated band 57 secured at one end by rivets 60, for example, to the mounting pad as indicated in FIG. 3. The clamp 56 also comprises a second shorter band 61 secured to the opposite side of the mounting pad by rivets, and a conventional type radiator clamp nut 62 shown in FIG. 2.

FIG. 6 shows clearly the clamping arrangement 58 which comprises a long band 63, a shorter band 64, and a radiator-type securing nut 65. Again, in FIG. 6 the fixed ends of the band 63 and 64 are secured by rivets to opposite inner faces of the walls 39 and 40, respectively.

The tube 18 is preferably a transparent tube and may be constructed of a polycarbonate material such as those sold under the trademark Lexan or Merlon. A bushing 67 is secured in one end of the tube 18 such as by being glued therein. The bushing 67 has a number of passages therethrough each for receiving a metallic sleeve 69 as shown in FIG. 4. One end of each sleeve 69 receives a male prong 70 of the lamp assembly 20 discussed in more detail hereinafter. The other end of each sleeve 69 is threaded to receive an attaching screw 71 (see also FIG. 3). Wiring couples through the nipple 50 as shown in FIG. 4 and individual wires attach by conventional means to the screws 71.

The other end of tube 18 fits within an annular recess 73 in the end of the housing 16. The tube 18 may be loosely held in the housings 14 and 16 but is maintained in place by virture of other connections discussed herein between the mounting pads, housings and cage. Alternatively, the tube 18 may be secured to housings 14 and 16 by either bonding or threading or both.

The lamp assembly 20 comprises a conventional fluorescent tube 74 having opposite electrical contacts 76 at either end. The fluorescent tube or lamp 75 is supported at opposite ends by conventional lamp holders 78. Each of these lamp holders comprises biasing means for biasing the contacts 76 toward the lamp.

The lamp assembly 20 also comprises a ground plane 80 which is constructed in the form of an arcuately shaped elongated dish as shown clearly in FIG. 5. A plug block 82 having male prongs 70 extending therefrom is disposed at one end of the ground plane 80. A collar 84 is also secured to the block 82 and extends about the holding means 78 interlocking with the ground plane 80 in a manner similar to that shown in FIG. 5. The block 82 may be secured by elongated screws to both the collar 84 and the end of the ground plane 80. These screws may extend through the annular flange 83 of the block 82. Each of the prongs 70 has wiring extending therefrom (not shown) connecting to the contact 76 at the front end and the wiring also extends in grooves 85 of the ground plane to the contact 76 at the other end. Thus, the ground plane serves, in addition to being a ground plane, also as a means for securing and conveying wiring from one end of the fluorescent tube to the other.

The opposite end of the lamp assembly also comprises a block 88 through which wires may extend. In this connection it is noted that two apertures 90 in the block 88 are in alignment with the channels 85 in the ground plane 80. A collar 92 is provided similar to the collar 84. Collar 92 is shown in FIG. 5 interlocking with the ground plane 80. In addition, a heat sink shield 94 is provided and abuts against the collar 92. The block 88, collar 92 and shield 94 may be secured together by screws 96 shown in FIG. 6 which extend through the block 88 into the collar 92 and also into the shield 94.

The lower screws 96 extend only through the block 88 into the ground plane. FIG. 5 shows the openings in the shield 94 and the ground plane 80 for accommodating these elongated rather small screws.

The collar 92 and the shield 94 are preferably constructed of a highly heat conductive material such as aluminum. With the arrangement as clearly shown in FIG. 4 there is excellent heat sinking through collar 92 and shield 94, and also through the relatively large section 95 of the housing 16. In this way a cold spot is created in area 97 as indicated in FIG. 4. In this way the lamp will operate at a much more efficient light level output.

Another feature of the present invention is the ready removal of the lamp assembly from the apparatus. For this purpose a loop 99 is provided secured to the block 88 by a screw 100 as shown in FIG. 4. By removing the cap 54 the loop 99 can be pulled and thereby the entire lamp assembly including the ground plane and the opposite end blocks are withdrawn from the tube 18 with the male prongs 70 disengaging from the sleeves 69. Further, once the lamp assembly has been withdrawn it has been relatively easy to remove two of the screws 96, which will remove the shield 94 so that a new lamp can be inserted in place. The entire lamp assembly can then be reinserted into the tube 18 with the loop 99 functioning as an aligning means with the loop 99 extending vertically and upwardly so that the proper male prongs 70 engage with the sleeves 69.

The housings 14 and 16 can also be easily disassembled from the mounting pads simply by removing the clamps 56 and 58. Further, the cage 22 is easily removed by removal of the bolts 31 and 42. The cage in addition to comprising the elongated bars 28 and 30 also includes protective ends 104 and 106, elongated center bar 108, and middle bar 109. All of these components of the cage may be constructed separately and welded together in a single unit.

The drawings also show wires 112 such as shown in FIG. 3 interconnecting between the nuts 51. This wiring 112 is for detecting any tampering with the device. In this connection also note the wiring 114 shown in FIG. 2.

Figure 7:
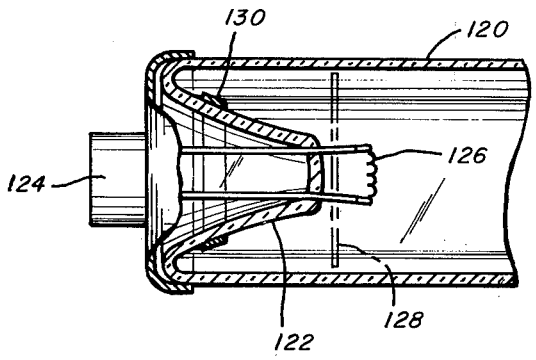
FIG. 7 is a partial cross-sectional view of a lamp construction of this invention.

FIGS. 1–6 show the basic components of the lighting apparatus of this invention. However, in an alternate preferred embodiment of the invention the heat sinking means disclosed in FIGS. 1–6 may be removed and a specially designed fluorescent tube is substituted for the conventional fluorescent tube 75 shown in FIGS. 1–6. FIG. 7 shows a fragmentary cross-sectional view of a fluorescent tube design in accordance with the invention. FIG. 7 shows the glass envelope 120 in which the fluorescent gasses are contained. The glass tube 120 is sealed to a flared member 122 which is of tulip-shape. A connector 124 is disposed at the end of the tube and has wiring coupling to a heater coil 126. The construction including the glass envelope, member 122 and the heater coil is well known. There is also conventionally provided a heat shield which is shown in dotted in FIG. 7. It is shown in dotted because in accordance with this invention it is preferred that the heat shield 128 not be used.

To improve the efficiency of the light output a patch or band of indium 130 is coated or otherwise deposited about the member 122 preferably in a continuous band. This indium amalgam readily bonds to the glass member 122 and tends to attract mercury particles, also tending to maintain a more homogeneous vapor pressure within the lamp. Because of the presence of this indium patch the heat shield is no longer necessary and with the removal of the heat shield then the illumination extends to the very end of the lamp which is more desirous. In effect, the indium patch tends to create a cold spot collecting mercury particles and stabilizing the vapor pressure within the envelope. In an alternate embodiment the amalgam patch may be deposited on the inner surface of the envelope itself or even on the outer surface of the envelope and may be deposited at the ends of the tube or even in the center of the tube.

Figure 8:
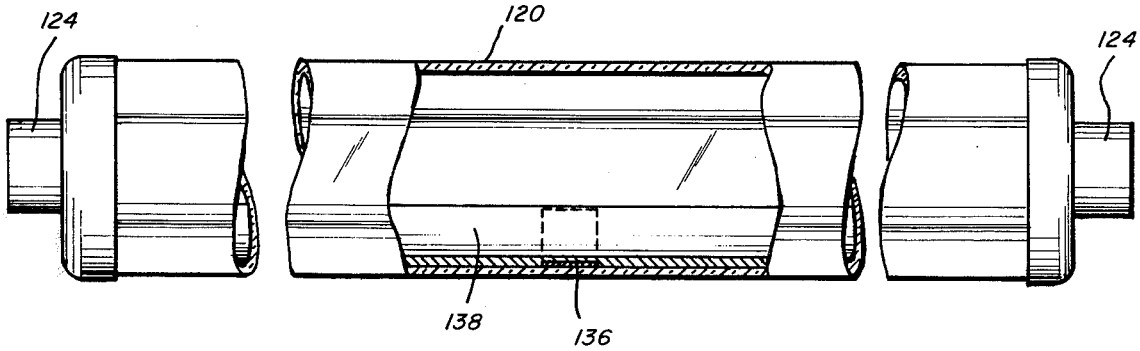
FIG. 8 is a partial cross-sectional view of a preferred lamp construction in accordance with this invention.

FIG. 8 shows the preferred construction of the lamp. In FIG. 8 there is shown the glass envelope 120 having the conventional connector ends 124. In the preferred embodiment the heat shields shown in dotted in FIG. 7 are preferably removed in the embodiment shown in FIG. 8. On the inner surface at the middle of the glass envelope 120 there is deposited the indium patch 136. The metallic reflector 138 is then deposited on the inner surface of the glass envelope. The reflector 138 extends about the glass envelope through an angle of approximately 135°. The lamp shown in FIG. 8 is positioned in the assembly shown in FIGS. 1–6 in the position shown in FIG. 8 with the reflector directing light upwardly.

Although the arrangement shown in FIG. 7 provided some improvement in operation it is theorized that the patches near the ends of the lamp are exposed to the full heat of the hot electrodes and therefore it is difficult to create the necessary "cold spot" for maintaining a high efficiency output from the lamp. The center of the lamp is cooler and thus the amalgam patch functions more effectively in this area. Without the use of end shields in the embodiment of FIG. 8 a portion of the heat normally directed toward the center of the lamp by the shields is distributed towards the ends of the tube away from the amalgam patch. This therefore also assists in improving the light output. Also, without the shields the dark areas normally found behind the shields is allowed to fluoresce adding 10–15% more light output to the lamp.

Having described one embodiment of the present invention, it should now become apparent to those skilled in the art that numerous modifications can be made in this embodiment all of which are contemplated as falling within the scope of this invention. For example, the components can be made of various types of materials. The cage has been shown as constructed of a metal material but could also be constructed of a durable non-metallic material. A loop has been shown for withdrawing the lamp assembly but other like means could be provided for withdrawing the lamp assembly. The invention is not to be limited by the disclosed embodiments but is meant to be limited solely by the appended claims.

What is claimed is:

1. A lighting apparatus comprising;

one and another spaced support structures each including a housing having a through passage defining in part a chamber in the housing, at least translucent tube means extending between the support structures and received thereby, connector means disposed in the chamber of said one support structure adjacent one end of said tube means, and a lamp assembly slideably received by the tube means, said lamp assembly comprising, a tubular fluorescent lamp, a pair of spaced lamp holders, a connector block at one end of the lamp assembly adjacent one of the holders, a ground plane extending longitudinally of the lamp in a direction between holders, a support block at the other end of the lamp assembly, means securing the ground plane at one end to the connector block and at the other end to the support block with the ground plane spaced only a slight distance from the lamp along its length, and means secured to said support block on the side thereof opposite said lamp to enable pulling of the lamp assembly from the tube, said passage in said other support structure having a minimum diameter greater than the maximum diameter of the lamp assembly so as to permit withdrawal of the lamp assembly, in toto, from the tube through said other support structure.

2. A lighting apparatus as set forth in claim 1 wherein said ground plane has an arcuate shape with channels for receiving electrical wiring.

3. A lighting apparatus as set forth in claim 1 wherein said lamp assembly comprises a heat sink shield extending over a part of the lamp opposite to the ground plane.

4. A lighting apparatus as set forth in claim 1 further comprising a mounting means for supporting each housing.

5. A lighting apparatus as set forth in claim 4 wherein the connector means in the one housing includes a female connector and the connector block of the lamp assembly includes a male connector.

6. A lighting apparatus as set forth in claim 4 including caps for sealing the outer ends of the passages in each housing.

7. A lighting apparatus as set forth in claim 4 wherein the one housing has an opening for receiving wiring for the connector means in the housing.

8. A lighting apparatus as set forth in claim 4 wherein each of the holding means includes spring loaded means.

9. A lighting apparatus as set forth in claim 4 wherein the other housing is constructed of a heat conductive material and has ridge or fin means for increasing the total outer surface area thereof.

10. A lighting apparatus as set forth in claim 1 wherein said tube is received in the passages of said housings.

11. A lighting apparatus as set forth in claim 4 including clamp means for securing each housing in its respective mounting means.

12. A lighting apparatus as set forth in claim 4 including a protective cage mounted from the mounting means and extending over the lamp assembly and support structures.

13. A lighting apparatus as set forth in claim 1 including a collar associated with each holding means.

14. A lighting apparatus as set forth in claim 13 including a heat sink shield covering the other end of the tube and contacting the collar.

15. A lighting apparatus as set forth in claim 1 wherein said lamp assembly comprises heat sink means at least a portion of which extends over the glass part of the tubular lamp for creating a cold spot to improve operation of the lamp.

16. A lighting apparatus as set forth in claim 1 wherein said tubular fluorescent lamp is a high light output lamp having an amalgam patch associated therewith.

17. A lighting apparatus as set forth in claim 16 wherein said amalgam patch is disposed at a central area of the fluorescent lamp intermediate the ends of the fluorescent lamp.

18. A lighting apparatus as set forth in claim 17 wherein said fluorescent lamp has a metallic reflector disposed about a portion of the circumference of the lamp with the amalgam patch disposed intermediate the reflector and the fluorescent lamp tube.

19. A lighting apparatus as set forth in claim 2 wherein said channels extend between the ends of the ground plane and are each parallel to one another.

20. A lighting apparatus as set forth in claim 3 including a collar about the holder at the other end of the lamp assembly, said collar disposed between the support block and shield and having elongated screws securing the shield and collar to the support block.

21. A lighting apparatus as set forth in claim 1 wherein said lamp assembly further comprises one and another collar with screw means for securing the one collar to the connector block and the other collar to the support block, said collars both extending about the lamp greater than 180° said ground plane extending about the lamp less than 180°.

22. A lighting apparatus as set forth in claim 21 wherein said collars each interlock at their ends with the ground plane.

23. A lighting apparatus as set forth in claim 1 wherein said means to enable pulling includes a loop and means orienting the loop to correspond with the position of the connector block.

* * * * *